United States Patent [19]

Chambers et al.

[11] Patent Number: 4,988,453

[45] Date of Patent: Jan. 29, 1991

[54] TRANSPARENT SOAP BAR CONTAINING A MONOHYDRIC AND DIHYDRIC ALCOHOL

[75] Inventors: John G. Chambers; Terry Instone; Brian S. Joy, all of Wirral, England

[73] Assignee: Lever Brothers Company, Division of Conopco, Inc., New York, N.Y.

[21] Appl. No.: 486,032

[22] Filed: Feb. 27, 1990

[30] Foreign Application Priority Data

Mar. 3, 1989 [GB] United Kingdom ..... 8904938

[51] Int. Cl.[5] ..... C11D 9/00; C11D 15/04; C11D 9/22; C11D 17/00

[52] U.S. Cl. ..... 252/122; 252/123; 252/125; 252/128; 252/130; 252/132; 252/134; 252/DIG. 5; 252/DIG. 16

[58] Field of Search ..... 252/122, 134, 132, DIG. 16

[56] References Cited

U.S. PATENT DOCUMENTS

| | | | |
|---|---|---|---|
| 78,182 | 5/1868 | Brown | 252/122 |
| 1,626,708 | 5/1927 | Villain | 252/122 |
| 3,793,214 | 2/1974 | ONeill et al. | 252/134 |
| 3,903,008 | 9/1975 | Deweever | 252/134 |
| 3,926,828 | 12/1975 | O'Neill et al. | 252/134 |
| 3,969,259 | 7/1976 | Lages | 252/122 |
| 4,165,293 | 8/1979 | Gordon | 252/DIG. 16 |
| 4,206,069 | 6/1980 | Borrello | 252/DIG. 16 |
| 4,290,904 | 9/1981 | Poper et al. | 252/134 |
| 4,297,230 | 10/1981 | Rasser | 252/134 |
| 4,468,338 | 8/1984 | Lindberg | 252/134 |
| 4,490,280 | 12/1984 | Joshi et al. | 252/134 |
| 4,504,465 | 4/1985 | Sampson et al. | 514/751 |

FOREIGN PATENT DOCUMENTS

| | | | |
|---|---|---|---|
| 283091 | 9/1988 | European Pat. Off. . | |
| 284765 | 10/1988 | European Pat. Off. . | |
| 335026 | 4/1989 | European Pat. Off. . | |
| 51-024606 | 2/1976 | Japan . | |
| 275399 | 12/1986 | Japan | 252/134 |
| 1378437 | 12/1974 | United Kingdom . | |
| 2142040 | 6/1983 | United Kingdom . | |

OTHER PUBLICATIONS

J63057699-Shiseido (Abstract Enclosed).
J61190597-Shiseido (Abstract Enclosed).
J60181199-Shiseido (Abstract Enclosed).

*Primary Examiner*—Dennis Albrecht
*Assistant Examiner*—Kevin McCarthy
*Attorney, Agent, or Firm*—Ronald A. Koatz

[57] ABSTRACT

Translucent detergent bar contains 30 to 45 wt % soap, 5 to 15 wt % monohydric alcohol and 5 to 15 wt % dihydric alcohol whose molecule contains at least one alkylene group with at least three carbon atoms and water. Optional ingredients include up to 10 wt % non-soap detergent and polyhydric alcohols, sugars and polyalkylene glycols. The combination of monohydric and dihydric alcohols promotes translucency while avoiding disadvantages observed with either of them alone. The bars can be made by forming a melt of the component ingredients, casting the melt into molds and allowing it to set.

10 Claims, No Drawings

TRANSPARENT SOAP BAR CONTAINING A MONOHYDRIC AND DIHYDRIC ALCOHOL

The present invention relates to a detergent bar, particularly to a detergent soap-based bar having a translucent appearance.

Translucent and transparent soaps have for many years held an aesthetic appeal to consumers. Such bars can however be costly to produce, compared to conventional opaque soap bars, due to special processing techniques required to achieve the translucent or transparent effect. Transparent and translucent bars usually moreover have one or more properties inferior to those of opaque bars. In particular translucent and transparent bars can have a high rate of wear and an increased tendency to go mushy on contact with water. In order to produce a translucent or transparent bar of relatively good user properties it has been usual to ensure that its soap content is at least about 50 to 60 wt % of the final bar. The remaining ingredients usually comprise one or more components believed to be essential to render the bars translucent or transparent. Such ingredients have in the past included alcohol, glycerine and sugar and where transparency is particularly important rosin and castor oil. A review of transparent and translucent soaps having such a relatively high soap content is found at pages 465 to 472 of "Soap Manufacture" Vol. I by J. Davidsohn, E. J. Better and A. Davidsohn published by Interscience Publishers, Inc., New York 1953.

Although translucent soap bars having a reduced soap content, and hence potentially a reduced manufacturing cost, have been proposed occasionally in the past, such bars have been bedevilled by such disadvantages as: poor user properties e.g. high water uptake, poor mush, opaque mush, poor lather, high rate of wear; soft bars which are easily malleable; poor translucency; hygroscopic, sticky surface; and long preparative maturation times. Knowing that these many problems exist has meant that translucent bars having a reduced soap content have generally been avoided as product concepts or when attempted have been viewed as inferior products only.

Examples of formulations suggested having a relatively low soap content but aimed at particularly needs are found in U.S. Pat. Nos. 4,165,293 and 4,206,069.

U.S. Pat. No. 4,165,293 (Amway Corporation) describes a solid transparent soap containing 25 to 55 wt % sodium soap, 10 to 40 wt % anionic or amphoteric surfactant and 65 to 15 wt % C2 to C6 dihydric alcohol. The transparency is said to be derived solely from the selected soap/anionic/dihydric mixture. Only very small amounts of ethanol (<5 wt %) and glycerine (cosmetic amounts only) are tolerated.

U.S. Pat. No. 4,206,069 (Colgate Palmolive Company) relates to small transparent pellets suitable for ready dissolution for use in fabric washing solutions. The aim of the disclosure is to provide non-sticky, free-flowing substantially non-hygroscopic detergent pellets. The formulation disclosed in U.S. Pat. No. 4,206,069 for providing such pellets comprises a matrix of 15 to 50 wt % defined fatty acid soap, 10 to 65 wt % defined synthetic detergent component and 10 to 45 wt % solvent consisting essentially of at least one normally liquid substantially non-volatile organic solvent having a boiling point of at least 100° C., and 1 to 35 parts of water per 100 parts matrix. At least 10 wt % of the non-volatile fraction of the solvent is a dihydric alcohol.

The softness, tackiness and hygroscopicity of the pellets is controlled by limiting the proportions of water soluble solvents and employing water insoluble solvents, such as benzyl alcohol.

We have now found that production of transparent or translucent bars containing a low level of soap is facilitated by incorporating a mixture of monohydric and dihydric alcohols.

Broadly the present invention provides a translucent detergent bar containing, with respect to the total weight of the bar, 30 to 45% by weight of soap, 5 to 15% by weight of a monohydric alcohol and 5 to 15% by weight of a dihydric alcohol whose molecule contains at least one alkylene group with at least three carbon atoms therein. The bar will contain some water and preferably contains some non-soap surfactant and/or an additional component which is a sugar, polyhydric alcohol or polyalkylene glycol. The combination of monohydric and dihydric alcohols promotes translucency while avoiding disadvantages observed with either of them alone. The additional preferred constituents can further promote translucency of the bar.

By "translucent" we mean capable of transmitting light. The bar may appear somewhat hazy but will not be totally opaque. Bars embodying the present invention can have a high degree of translucency and even be deemed transparent as defined by the ability to read readily bold face type of 14 print size through a ¼ inch section of material (for further details of this test see U.S. Pat. No. 3,274,119).

We have found that the present invention enables manufacture of bars having acceptable properties and which can be highly translucent. In addition the present bars can be made by a process that avoids long maturation times. The present bars can preferably have a setting temperature of at least 40° C., more preferably at least 45° C., better still at least 50° C. The ability to prepare bars having such setting temperatures using the present formulations means that the resulting bars are compatible with hot water hand wash conditions and in addition can tolerate high ambient temperatures often encountered during storage prior to sale.

Preferably the soap content of the present composition comprises a mixture of soluble soaps and insoluble soaps. By "soluble" soaps we mean the monovalent salts of saturated fatty monocarboxylic acids having a carbon chain length of from 8 to 14 and additionally the monovalent salts of oleic acid and polyunsaturated fatty monocarboxylic acids having a carbon chain length of between 8 and 22. By "insoluble" soaps we mean monovalent salts of saturated fatty monocarboxylic acids having a carbon chain length of from 16 to 24, e.g. palmitate and stearate.

It is desirable that bars of this invention should include, with respect to the total weight of the finished bar, at least 10 wt % insoluble soaps, more preferably at least 12 wt % insoluble soaps.

A bar of this invention may contain, with respect to the total weight of the bar, 10 to 20 wt % of insoluble soaps, preferably 12 to 18 wt %, and 3 to 25 wt % saturated soaps having a carbon chain length of from 8 to 14 and 0 to 20 wt % oleate, typically 2 to 18 wt % and polyunsaturated soaps. Preferably the insoluble soap component comprises, with respect to the total weight of the final bar, 12 to 16 wt % palmitate and/or stearate soaps and 0 to 6 wt % of other saturated soaps having a chain length of 20 to 22 carbon atoms. Suitably the monovalent cations in the soap are alkali metal e.g.

sodium and/or ammonium substituted with one or more alkyl or alkanol $C_1$ to $C_3$ groups.

The selection of soaps may depend on availability and cost of supply. Suitably however the present soluble soaps are derived from coconut oil, palm kernel oil and/or babassu oil, in addition to unsaturated soaps such as oleate or mixtures of oleate and linoleate. Appropriate sources of insoluble soaps include tallow, tallow stearine, hydrogenated soyabean oil, hydrogenated rice bran oil, hydrogenated fish oil, palm stearine. Preferably a source or mixture of sources is employed which supplies an insoluble soap component containing soaps having at least two different chain lengths in order to ensure good translucency.

The requirement for at least 10 wt % of insoluble soap can be met by using a mixture of tallow and coconut oils in which the proportion by weight of tallow to coconut is 70:30 or higher, e.g. 80:20. Alternatively, a lower ratio can be used if the tallow oil is hardened. An example of this fully hardened tallow would be a tallow: coconut ratio of 33:67.

The absolute amount of soap present in the present bar may extend on occasion outside the 30 to 45 wt % range recited above. Soap is a natural product and may vary in its make up slightly from supply to supply permitting the production of bars according to the present invention and yet having a total soap content a little below 30 wt % or a little above 45 wt %. Preferably however bars embodying the present invention have a total soap content in excess of 34 wt %, preferably a soap content lying in the range 35 to 45 wt %.

In this invention the bars must contain a monohydric alcohol in an amount which is 5 to 15%, preferably 6 to 15% of the bar composition. This monohydric alcohol will generally contain up to 3 carbon atoms per molecule. Examples are industrial methylated spirits, ethanol and isopropanol. Industrial methylated spirits and ethanol are preferred.

The bars must also contain a dihydric alcohol wherein the molecule contains at least one alkylene group of at least three carbon atoms. This is present in an amount which is 5 to 15% preferably 6 to 14% of the bar composition. Examples are propane-1,2-diol, propane-1,3-diol and dipropylene glycol. Each of the monohydric alcohol and dihydric alcohol selected should be water soluble/miscible.

Very desirably the bars also contain an additional component which is a member selected from the group comprising polyhydric alcohols, sugars, polyalkylene glycols and mixtures thereof. Examples of such ingredients include one or a mixture of:

(i) sugars such as sucrose, fructose and glucose, (ii) linear or cyclic polyols wherein the molecule contains 3 or more carbon atoms and 3 or more alcohol groups such as glycerol, sorbitol or mannitol, (iii) a di or polyalkylene glycol such as diethylene glycol, triethylene glycol or polyethylene glycol having a molecular weight in the range from 400 to 6000.

This additional component which should be water soluble/miscible may possibly be used in an amount, with respect to the final bar, which is 5, preferably 10, to 25 wt %. The presence of this additional component can aid the transparency of the bar.

Water employed in the bars of this invention is preferably distilled or deionised. The amount of water is determined in general by the levels of other materials present. Suitably however the amount of water appropriate to yield acceptable bars for any one formulation will lie between about 15 and 27 wt %. For formulations containing sucrose, propan-1,2-diol and industrial methylated spirits we have found that a suitable solvent blend is one having a ratio of industrial methylated spirits:propan-1,2-diol:sucrose:water of about 1:1:2:2.

Bars of this invention may include a small amount, up to 5 wt %, more preferably up to 2 wt %, of the bar composition, of a water-soluble polymer having a molecular weight of over 5000. We have found that the incorporation of such polymers increases translucency. Suitable polymers include polysaccharides such as guar gums, gelatin and synthetic polymers such as polyvinylpyrrolidone.

Bars of this invention may include some non-soap surfactant. Such surfactants can deliver additional benefits in the finished bar, notably improved transparency, relative to the same formulation in the absence of a non-soap surfactant. We have found it is possible to include cationic, anionic, nonionic or amphoteric non-soap surfactants, in amounts up to 10% by weight, more preferably up to 6% by weight, based on the total bar composition. With such an amount of non-soap surfactant the amount of soap is at least three times the amount of non-soap surfactant. Only such limited amounts of non-soap surfactant are preferred in order to retain good rate of wear properties in the finished bar. Mild non-soap surfactants suitable for inclusion in toilet washing bars tend to be highly water soluble and hence can lead to a detraction in bar properties.

Examples of non-soap surfactants that it has been found can be included without reducing the bar's transparency and acceptable user properties include sodium alkyl ether sulphates, alkyl benzene sulphonates, dialkyl sulphosuccinates, sodium alkyl betaines and alkyl and dialkyl ethanolamides. Sodium rosinate, although a soap, can be included in this group.

Particular examples of mild synthetic non-soap detergents suitable for inclusion in the present bar include: cationics such as polypropoxy diethyl methyl ammonium chloride (mmw=2500) (e.g. Emcol CC-42), polypropoxy diethyl methyl ammonium chloride (mmw=600) (e.g. Emcol CC-9), dimethyl dicococyl ammonium chloride (e.g. Arquad 2C), distearyl dimethyl ammonium chloride (e.g. WK Pulver), dimethyl tetradecyl 2-hydroxyethyl ammonium chloride, and di-hardened tallow dimethyl ammonium chloride; amphoterics such as stearyl dimethyl betaine (e.g. Amphitol 86B), lauryl dimethyl betaine (e.g. Empigen BB), coco amidopropyl betaine (e.g. Tegobetaine L7); nonionics such as lauryl alcohol polyethoxylate (4) (e.g. Brij 30), oleyl alcohol polyethoxylate (20) (e.g. Brij 98), anionics such as disodium lauryl sulphosuccinate (e.g. Rewopol SBF12), disodium lauric acid monoethanolamide sulphosuccinate (e.g. Rewopol SBL 203), disodium lauryl polyethoxy sulphosuccinate (e.g. Rewopol SBFA), sodium di-2-ethylhexyl sulphosuccinate (e.g. Aerosol OT), disodium ricinoleic acid monoethanolamide sulphosuccinate (e.g. Rewoderm S1333), sodium lauryl ether sulphate (e.g. Empicol 0251), sodium lauryl ether carboxylate (e.g. Akypo RLM).

Additional ingredients such as antioxidants e.g. butylhydroxy toluene, sodium sulphite and ethylenediaminetetraacetic acid; dyes; perfumes; and pearlescer can if desired be included in soap bars of this invention.

According to a second aspect of the present invention there is provided a method of making a translucent bar comprising forming a melt at a temperature of between 60° C. and 85° C. of a mixture comprising 30 to 45 wt % soap, 5 to 15 wt % monohydric alcohol, 5 to 15 wt % dihydric alcohol, and water, and cooling the melt to 30° C. or less.

Suitably the soap is added to and dissolved in the remaining ingredients which have already obtained a temperature of 60° C. to 85° C. We have found that such a method ensures the provision of an isotropic solution prior to cooling. The moulds can if desired additionally serve as the eventual packaging material for example as described in our co-pending GB patent application 8729221 or once cooled and set the bars or slabs can be removed from the moulds, finished as necessary, and packed.

Other than cooling to allow the melt to set the present method employing the presently recited formulation does not need any maturation time for the translucency to develop. In practice we have found that the present melt is itself translucent and cools and set directly to a translucent solid form.

Embodiments of the present invention will now be described by way of example with reference to the following Examples:

EXAMPLES 1 TO 5

Bars were made by the following procedure. Each of the ingredients other than soap was mixed and heated to 85° C. The soap was then added and dissolved. The resulting melt solution was poured into individual moulds and cooled slowly to ambient temperature to allow it to set. The formulation in each case employed a soap mixture comprising a 80:20 blend of tallow:-coconut soaps and a solvent blend comprising industrial methylated spirit (a 90:10 blend of ethanol: methanol), propan-1,2-diol, sucrose and water at a fixed ratio of 1:1:2:2. The examples differed in the proportion of soap to solvent. These proportions and the appearance of the respective melts and resulting bars are given in Table I below.

TABLE I

| Example | Soap:Solvent | Melt at 85° C. | Bars |
|---|---|---|---|
| 1 | 35:65 | isotropic | clear hard coagel |
| 2 | 40:60 | isotropic | clear hard coagel |
| 3 | 45:55 | isotropic | clear hard coagel |
| 4 | 47:53 | isotropic | clear hard coagel |
| 5 | 50:50 | lamellar/solution | opaque soft liquid |

Thus at a soap content of 50 wt % the melt adopted the form of a lamellar liquid crystal phase resulting in a soft opaque product. For the present system therefore a maximum soap content would appear to be about 47 wt %.

The bars of Examples 1 and 3 containing 35 and 45 wt % soap respectively were evaluated relative to a control bar of conventional opaque 80:20 tallow:coconut soap. The results are given in Table II below.

TABLE II

| Example | % Wear | Subjective Mush | Lather (Volume) |
|---|---|---|---|
| 1 | 35.3 | 0 | 39.3 |
| 3 | 33.4 | 2.7 | 43.3 |
| control | 24.3 | 10.1 | 41.0 |

Thus both the bars of Examples 1 and 3 had acceptable rate of wear, subjective mush and lather properties relative to the control, although a slight decrease in properties could be seen as the soap content decreased from 45 to 35 wt % in bars embodying the present invention.

EXAMPLES 6 TO 12

Bars were made according to the procedure described under Examples 1 to 5 employing the formulations given in Table III below.

TABLE III

| Example | 6 | 7 | 8 | 9 | 10 | 11 | 12 |
|---|---|---|---|---|---|---|---|
| Soap | 40 | 40 | 40 | 40 | 40 | 40 | 40 |
| Brij 30 | — | — | 5 | — | — | — | — |
| Rewopol SBFA 30/40 | — | — | — | 5 | — | — | — |
| Propan-1,2-diol | 10 | 12 | 9.2 | 9.2 | 15 | 17.5 | 20.0 |
| Industrial methylated spirit | 10 | 12 | 9.2 | 9.2 | 9.0 | 8.5 | 8.0 |
| Sucrose | 20 | 18 | 18.3 | 18.3 | 18.0 | 17.0 | 16.0 |
| Distilled water | 19 | 17 | 17.3 | 17.3 | 17.0 | 16.0 | 15.0 |
| Perfume | 1.0 | 1.0 | 1.0 | 1.0 | 1.0 | 1.0 | 1.0 |

The soap employed was a 80:20 blend of tallow:cocount soap. Brij 30 is the nonionic lauryl alcohol polyethoxylate (4EO). Rewopol SBFA 30/40 is disodium lauryl polyethoxy sulphosuccinate.

Each of the bars appeared transparent and hard. The bars were subjected to a sweating test which was designed to mimic the humid atmospheric conditions frequently found in modern bathrooms where poor ventilation in combination with the use of hot water can produce a high relative humidity.

The test employed comprised storing the bars under ambient conditions with a relative humidity of 85% and examining visually the products daily for evidence of sweating. The presence of sweat was scored on a ten-point scale, 0 signifying absence of sweat and 10 signifying a bar coated with a wet layer. The results are given in Table IV below.

TABLE IV

| Example | Day 1 | Day 2 | Day 5 | Day 7 |
|---|---|---|---|---|
| 6 | 0 | 0 | 2 | 2 |
| 7 | 0 | 0 | 1 | 2 |
| 8 | 0 | 0 | 2 | 2 |
| 9 | 0 | 0 | 2 | 2 |
| 10 | 0 | 0 | 4 | 4 |
| 11 | 0 | 10 | 10 | 10 |
| 12 | 0 | 10 | 10 | 10 |

Thus an excessive degree of sweating was seen in Examples 11 and 12 which was associated with a level of propan-1,2-diol in excess of 15 wt %.

EXAMPLES 13 TO 16

A series of bars was prepared by the procedure described under Examples 1 to 5 employing formulations comprising 40 wt % soap, consisting of a 80:20 blend of tallow:coconut soap, and 60 wt % of a solvent blend. The solvent blend varied between the formulations and consisted of respectively 2, 5, 7 and 10 wt %, with respect to the whole formulation, propan-1,2-diol, and 58, 55, 53 and 50 wt %, with respect to the whole formulation, of a mixture of industrial methylated spirit, water, sucrose in a ratio of 1:2:2. The appearances of the melt and resulting bar were observed in each case. The results are given in Table V below.

TABLE V

| Example | Level of propan-1,2-diol, (wt %) | Melt | Bar |
|---|---|---|---|
| 13 | 2 | LC | O |
| 14 | 5 | L | C |
| 15 | 7 | L | C |
| 16 | 10 | L | C |

LC = liquid crystalline material present
L = isotropic solution
O = opaque soft product
C = clear hard product Thus only Examples 14 to 16 i.e. those formulations containing 5 wt % or more of propan-1,2-diol yielded transparent hard bars of soap.

EXAMPLES 17 TO 22

A series of bars was prepared following the procedure described under Examples 1 to 5 employing formulations comprising 40 wt % soap, consisting of a 80:20 blend of tallow:coconut soap, and 60 wt % of a solvent blend. The solvent blend varied between the formulations and consisted of respectively 2, 5, 7, 10, 14 or 16 wt %, with respect to the total formulation, of industrial methylated spirits and 58, 55, 53, 50, 46 and 44 wt %, with respect to the total formulation, of a mixture of propan-1,2-diol, sucrose and water in a ratio of 1:2:2. The appearances of the melt and resulting bar for each formulation were observed. The results are given in Table VI below.

TABLE VI

| Example | Level of Industrial Methylated Spirit (wt %) | Melt | Bar |
|---|---|---|---|
| 17 | 2 | LC | O |
| 18 | 5 | L | C |
| 19 | 7 | L | C |
| 20 | 10 | L | C |
| 21 | 14 | L | C |
| 22 | 16 | I | I |

LC = liquid crystal material present
L = isotropic solution
I = insoluble material present
O = opaque soft product
C = clear hard product Thus only Examples 18 to 21, i.e. those formulations containing 5 or more wt % and less than 16 wt % industrial methylated spirit yielded transparent hard bars of toilet soap.

EXAMPLES 23 TO 29

A series of bars was prepared following the procedure described under Examples 1 to 5. The formulation employed contained 40 wt % soap, comprising a 80:20 blend of tallow:coconut soap, and 60 wt % of a solvent blend. The solvent blend comprised, with respect to the total formulation, 0, 6, 10, 14, 20, 24 or 26 wt % sucrose and respectively, with respect to the total formulation, 60, 54, 50, 46, 40, 36 or 34% of a solvent mixture of industrial methylated spirits, propan-1,2-diol and water in a ratio of 1:1:2. The appearance of the melt and the resulting bar were observed in each case. The results are given in Table VII below.

TABLE VII

| Example | Level of Sucrose (wt %) | Melt | Bar |
|---|---|---|---|
| 23 | 0 | L | H |
| 24 | 6 | L | C |
| 25 | 10 | L | C |
| 26 | 14 | L | C |

TABLE VII-continued

| Example | Level of Sucrose (wt %) | Melt | Bar |
|---|---|---|---|
| 27 | 20 | L | C |
| 28 | 24 | L | C |
| 29 | 26 | L | O |

L = isotropic solution
H = hazy hard product
C = clear hard product
O = opaque soft product Examples 24 to 28 containing between 6 and 24 wt % sucrose gave transparent hard bars of soap. Example 23 containing no sucrose gave a translucent bar of acceptable hardness and reduced transparency relative to the bars of Examples 24 to 28. Example 26 yielded a bar which was both opaque and soft. Acceptable bars can thus be made in the absence of sucrose, or with sucrose present, which is preferred, at levels between about 5 and 25 wt % with respect to the total formulation.

EXAMPLES 30 TO 35

A series of bars was prepared following the procedure described under Examples 1 to 5. The formulations employed contained 40 wt % of a soap blend, comprising a 80:20 blend of tallow:coconut soap, and 60 wt % of a solvent blend. The solvent blend comprised, with respect to the total formulation, 14, 16, 18, 20, 26 or 28 wt % water and respectively, with respect to the total formulation, 46, 44, 42, 40, 34 or 32 wt %, of a solvent mixture comprising industrial methylated spirit, propan-1,2-diol and sucrose in a ratio of 1:1:2. The appearance of both the melt and resulting bar was noted in each case and the results are given in Table VIII below.

TABLE VIII

| Example | Level of Water (wt %) | Melt | Bar |
|---|---|---|---|
| 30 | 14 | I | I |
| 31 | 16 | L | C |
| 32 | 18 | L | C |
| 33 | 20 | L | C |
| 34 | 26 | L | C |
| 35 | 28 | LC | O |

I = insoluble material present
L = isotropic solution
LC = liquid crystalline material present
C = clear hard product
O = opaque soft product Thus acceptable hard toilet bars were produced by Examples 31 to 34 i.e. by the present formulations containing between about 15 and 27 wt % water.

EXAMPLES 36 TO 43

A series of bars was prepared by the procedure described under Examples 1 to 5 above in which the type of soap blend employed was varied. The formulation employed in the present examples otherwise comprised 40 wt % soap blend, 10 wt % industrial methylated spirit, 10 wt % propan-1,2-diol, 20 wt % sucrose, 19 wt % water and 1 wt % perfume. Table IX below gives the soap blend employed in each case and the results of evaluation studies performed. Included in the table as a control is a 80:20 tallow:coconut soap conventional opaque soap bar.

TABLE IX

| Example | Soap Blend | % Wear | Subjective Mush | Lather mag. estimate |
|---|---|---|---|---|
| 36 | tallow:coconut 90:10 | 27.8 | 2.0 | 0.67 |
| 37 | tallow:coconut 85:15 | 27.6 | 2.5 | 0.72 |
| 38 | tallow:coconut 80:20 | 28.0 | 2.7 | 0.93 |
| 39 | tallow:coconut 60:40 | 31.9 | 4.2 | 1.02 |
| 40 | tallow:coconut 50:50 | 42.3 | 4.8 | 1.13 |
| 41 | (50:50 palmitic: stearic): coconut 0:100 | 96.2 | 95.7 | 0.56 |
| 42 | (50:50 palmitic: stearic): coconut 25:75 | 30.6 | 10.1 | 0.98 |
| 43 | (50:50 palmitic: stearic): coconut 37:63 | 30.8 | 3.7 | 0.96 |
| Control | | 24.3 | 10.1 | 0.90 |

The relatively high rate of wear of Examples 40 and 41 was attributable to each bar containing relatively low levels of insoluble soaps i.e. soap components having a carbon chain length of at least 16. Example 40 had such an insoluble soap level of 11 wt % and Example 41 an insoluble soap level of 4.4 wt % with respect to the total weight of the bar. In practice a lower level of 12 wt % insoluble soaps with respect to total bar weight is preferred in order to yield a good wear rate. Examples 40 and 41 also notably had a setting temperature of less than 45° C.

The relatively low scores in Example 36 for subjective mush and lather were attributable to the somewhat low level of coconut soap present yielding a total soluble soap content, defined as soap components of 12 carbon atoms or less, in the bar of 4.8 wt %. In practice a preferred lower limit for the soluble soap component in the bar is 5 wt %.

EXAMPLES 44 TO 48

A series of bars was produced, following the procedure described under Examples 1 to 5, which included a synthetic detergent. In each case the bar comprised 40 wt % of a mixture of soap and co-active synthetic detergent and 60 wt % of a solvent blend. The solvent blend employed comprised 18.3 to 19.3 wt % sucrose, 9.2 to 9.7 wt % industrial methylated spirit, 9.2 to 9.7 wt % propan-1,2-diol, 17.3 to 18.3 wt % water and 1 wt % perfume, with respect to the final bar composition. The soap employed was a 80:20 blend of tallow:coconut soap. Table X below gives the co-active used, its level with respect to the total bar composition, and evaluation data on the resulting bars. The control bar was a 80:20 tallow:coconut soap conventional opaque toilet bar.

TABLE X

| Example | Co-active | Level (wt %) | Wear (%) | Subjective Mush | Lather (mag. estimate) |
|---|---|---|---|---|---|
| 44 | Empigen BB | 5 | 28.7 | 7.2 | 1.13 |
| 45 | Tegobetaine | 5 | | | |
| 46 | Tegobetaine | 2 | 32.9 | 8.2 | 1.08 |
| 47 | Brij 99 | 2 | 32.9 | 8.8 | 0.73 |
| 48 | Brij 30 | 1 | 31.4 | 8.1 | 0.81 |

TABLE X-continued

| Example | Co-active | Level (wt %) | Wear (%) | Subjective Mush | Lather (mag. estimate) |
|---|---|---|---|---|---|
| Control | | | 23.1 | 4.3 | 1.03 |

Emigen BB is lauryl dimethyl betaine
Tegobetaine is coco amidopropyl betaine
Brij 99 is oleyl alcohol polyethoxylate (20)
Brij 30 is lauryl alcohol polyethoxylate (4)

Each of the bars of Examples 44 to 48 had acceptable user properties relative to the control bar. In addition it was noted that each of the bars of Examples 44 to 48 had a superior transparency relative to an equivalent bar containing 40 wt % of the same soap base, but no synthetic co-active, and 60 wt % of the same solvent blend.

At co-active levels over about 6 wt % with respect to the total bar composition it was noted that the setting temperature was lower and wear rates in hot water conditions was increased. Additionally at such higher co-active levels the bars tended to form an opaque mush on the bar surface during use.

EXAMPLES 49 TO 53

A series of bars was prepared, following the procedure described under Examples 1 to 5 above, containing 40 to 43 wt % of a soap blend, 58 to 52 wt % of a solvent blend solvent, and 2 to 5 wt % synthetic co-active detergent. The soap blend employed was a 80:20 blend of tallow:coconut soap. The solvent blend comprised 18.3 to 19.3 wt % sucrose, 9.2 to 9.7 wt % industrial methylated spirit, 9.2 to 9.7 wt % propan-1,2-diol, 17.3 to 18.3 wt % water and 1 wt % perfume. Table XI below gives in each case the co-active employed, its level of incorporation with respect to the total bar composition, and evaluation data on the resulting bars. The control bar included in the evaluation tests was a conventional opaque 80:20 tallow:coconut soap toilet bar.

TABLE XI

| Example | Co-active | Level (wt %) | Wear (%) | Subjective Mush | Lather Mag. estimate |
|---|---|---|---|---|---|
| 49 | Brij 98 | 5 | 27.3 | 8.0 | 0.93 |
| 50 | Aerosol OT | 5 | 27.1 | 8.0 | 1.08 |
| 51 | Tegobetaine L7 | 5 | 25.9 | 8.0 | 0.99 |
| 52 | Rewopol SBFA 30/40 | 5 | 23.7 | 7.0 | 0.96 |
| 53 | Monazoline | 2 | 30.7 | 0 | — |
| Control | | | 20.1 | 3.5 | 1.16 |

Brij 98 is oleyl alcohol polyethoxylate (20)
Aerosol OT is sodium di-2-ethylhexyl sulphosuccinate
Tegobetaine L7 is coco amidopropyl betaine
Rewopol SBFA 30/40 is disodium lauryl polyethoxy sulphosuccinate
Monazoline is coco imidazoline Each of the bars of Examples 49 to 53 had acceptable user properties relative to those of the control bar. Additionally it was noted that each of the bars of Examples 49 to 53 had a transparency superior to that of an equivalent bar containing no added synthetic co-active detergent. At a co-active level above 6 wt %, with respect to the total bar composition, however the user properties of the bar tended to reduce.

EXAMPLES 54 TO 58

A series of bars was prepared, following the procedure in Examples 1 to 5 above, in which the level of a single synthetic co-active detergent was varied from 0 to 7 wt %, with respect to the total bar composition.

The formulation comprised 40 wt % 80:20 tallow:-coconut soap and 60 to 53 wt % solvent comprising sucrose: industrial methylated spirits: propan-1,2-diol: water in a 2:1:1:2 ratio. The results in term of level of active employed, which was Rewopol SBFA 30/40, which is disodium lauryl polyethoxy sulphosuccinate, and the appearance of the respective melts and resulting bars are given in Table XII below.

TABLE XII

| Example | Level (wt %) | Melt Appearance (85° C.) | Bar Appearance (20° C.) |
|---|---|---|---|
| 54 | 0 | I | C/H |
| 55 | 4 | I | C |
| 56 | 5 | I | C |
| 57 | 6 | I | C |
| 58 | 7 | L | H/O |

I = Isotropic
L = Liquid crystal/solution mixture
C = Clear
H = Hazy
O = Opaque

EXAMPLES 59 TO 62

A series of bars was prepared, following the procedure under Examples 1 to 5 above, in which a variety of polyols was included in the solvent blend. The formulation employed comprised 40 wt % of a 80:20 tallow:-coconut soap blend and 60 wt % of a solvent blend consisting of, with respect to the total bar composition, 20 wt % polyol, 10 wt % industrial methylated spirit, 10 wt % propan-1,2-diol, 19 wt % distilled water and 1 wt % perfume. Table XIII below gives the polyols employed and evaluation data on the resulting bars. The control bar was a 80:20 tallow:coconut conventional opaque toilet bar.

TABLE XIII

| Example | Polyol | % Wear | Subjective Mush | Lather mag. estimate |
|---|---|---|---|---|
| 59 | Sorbitol:PEG400 1:1 | 36.8 | 7.0 | 0.97 |
| 60 | Sorbitol:PEG400:glycerol 1:1:1 | 37.8 | 5.5 | 0.98 |
| 61 | Sucrose:PEG400:glycerol 1:1:1 | 36.3 | 3.1 | 0.94 |
| 62 | glycerol | 35.3 | 6.7 | 1.1 |
| Control | | 23.1 | 4.3 | 1.03 |

PEG400 is polyethyleneglycol having an average molecular weight of 400.

Each of the bars of Examples 36 to 39 was deemed to have acceptable user properties relative to the control bar.

EXAMPLES 63 TO 67

A series of bars was prepared, following the procedure for Examples 1 to 5, in which up to 2 wt % of a polymer was incorporated. The formulation employed comprised 40 wt % of a soap blend consisting of 80:20 tallow:coconut soap, 20 wt % sucrose, 10 wt % industrial methylated spirit, 10 wt % propan-1,2-diol, 1 wt % perfume, and depending on the amount of polymer present 17 to 19 wt % water. Table XIV below gives the polymers employed, their level of incorporation with respect to the total bar formulation, and evaluation data on the resulting bars. The control bar was a conventional opaque 80:20 tallow:coconut soap toilet bar.

TABLE XIV

| Example | Polymer | Level | % Wear | Subjective Mush | Lather mag. estimate |
|---|---|---|---|---|---|
| 63 | Dextran | 1 | 31.4 | 5.2 | 0.95 |

TABLE XIV-continued

| Example | Polymer | Level | % Wear | Subjective Mush | Lather mag. estimate |
|---|---|---|---|---|---|
| 64 | JR/SL70 | 1 | 30.1 | 3.3 | 0.85 |
| 65 | JR/SL98 | 1 | 28.9 | 3.0 | 1.02 |
| 66 | Gelatin | 1 | 29.5 | 0.43 | 1.0 |
| 67 | Bermocoll | 1 | 29.6 | 3.06 | 1.01 |
| Control | | | 21.7 | 5.7 | 1.16 |

Dextran is a polysaccharide
JR/SL70 and JR/SL98 are 50:50 mixtures of polymer JR which is a cationic modified cellulose having a molecular weight in excess of 400,000 and SL70 or SL98 respectively which is each a methacrylate per polymer.
Bermocoll is a hydroxy cellulose The transparency of each of the bars of Examples 63 to 67 was noted to be superior to that of a bar of equivalent formulation but containing no polymer. The polymer is believed to inhibit large soap crystal formation, thereby improving transparency. The in-use properties of the bars of Examples 63 to 67 were deemed to be similar to those of the control bar.

The evaluation test employed in the above examples were carried out by an experienced panel hand-washing the bars according to a set regime. Rate of wear and mush of the bar surface were assessed by washing down the bars at intervals seven times daily over a four-day period and then examining and weighing the resulting bars. The scores used for wear and subjective mush indicate the lower the score recorded the better the observed property. The lather of the bars was either measured by recording the volume of lather produced in which case the higher the score the more lather was produced, or by a subjective estimate which was then analysed statistically and recorded as a "magnitude estimate" relative to a control bar.

We claim:

1. Translucent detergent bars comprising, with respect to the total weight of the bar, 30 to 45 wt % soap, 5 to 15 wt % monohydric alcohol having 1 to 3 carbon atoms, 5 to 15 wt % dihydric alcohol selected from the group consisting of propane-1,2-diol, propane-1,3-diol and dipropylene glycol, and water.

2. Detergent bar according to claim 1 including 5 to 25 wt % of a member selected from the group consisting of polyhydric alcohols, sugars, polyalkylene glycols and mixtures thereof.

3. Detergent bar according to claim 2 wherein the monohydric alcohol, dihydric alcohol, member selected from the group consisting of polyhydric alcohols, sugars, polyalkylene glycols and mixtures thereof, and water are present in a ratio of approximately 1:1:2:2.

4. Detergent bar according to claim 1 including up to 10 wt % in total of non-soap surfactant.

5. Detergent bar according to claim 4 including up to 6 wt % in total of non-soap detergent.

6. Detergent bar according to claim 1 including up to 5 wt % with respect to the total bar composition of a water soluble polymer having a molecular weight of over 5000.

7. Detergent bar according to claim 6 including up to 2 wt % with respect to the total bar composition of said water soluble polymer.

8. Detergent bar according to claim 1 wherein the soap with respect to the total weight of the bar comprises at least 10 wt % insoluble soap.

9. Detergent bar according to claim 1 wherein the soap with respect to the total weight of the bar comprises at least 5 wt % soluble soap.

10. Method of making a translucent bar comprising forming a melt at a temperature of between 60° C. and 85° C. of a composition according to claim 1 and cooling the melt to 30° C. or less.

* * * * *